US009593650B2

(12) United States Patent
Okada et al.

(10) Patent No.: US 9,593,650 B2
(45) Date of Patent: Mar. 14, 2017

(54) FUEL SUPPLY DEVICE AND SADDLE TYPE VEHICLE

(71) Applicants: YAMAHA HATSUDOKI KABUSHIKI KAISHA, Shizuoka (JP); Mitsubishi Electric Corporation, Tokyo (JP)

(72) Inventors: Shinsuke Okada, Shizuoka (JP); Takuya Uryu, Tokyo (JP)

(73) Assignees: YAMAHA HATSUDOKI KABUSHIKI KAISHA, Iwata-shi, Shizuoka (JP); MITSUBISHI ELECTRIC CORPORATION, Tokyo (JP)

( * ) Notice: Subject to any disclaimer, the term of this patent is extended or adjusted under 35 U.S.C. 154(b) by 226 days.

(21) Appl. No.: 14/223,434

(22) Filed: Mar. 24, 2014

(65) Prior Publication Data

US 2014/0290627 A1 Oct. 2, 2014

(30) Foreign Application Priority Data

Apr. 2, 2013 (JP) ..... 2013-076698

(51) Int. Cl.

| | |
|---|---|
| ***F02M 37/00*** | (2006.01) |
| ***F02M 37/22*** | (2006.01) |
| ***F02M 39/02*** | (2006.01) |
| ***F02M 37/20*** | (2006.01) |

(52) U.S. Cl.

CPC ..... *F02M 37/007* (2013.01); *F02M 37/20* (2013.01); *F02M 37/22* (2013.01); *F02M 39/02* (2013.01)

(58) Field of Classification Search

CPC ..... F02M 37/007; F02M 37/20; F02M 39/02; F02M 37/22; F02M 2037/228

USPC ..... 123/495, 509, 516

See application file for complete search history.

(56) References Cited

U.S. PATENT DOCUMENTS

| | | | | |
|---|---|---|---|---|
| 4,844,704 A | | 7/1989 | Jiro | |
| 5,054,453 A | * | 10/1991 | Onufer | B60K 15/03504 123/516 |
| 5,584,988 A | * | 12/1996 | Hashimoto | B01D 29/15 210/136 |
| 7,210,465 B2 | * | 5/2007 | Ikeya | B01D 35/027 123/510 |
| 7,478,729 B2 | * | 1/2009 | Sato | B01D 35/0273 210/172.4 |

(Continued)

FOREIGN PATENT DOCUMENTS

| | | |
|---|---|---|
| DE | 102009014510 A1 | 6/2010 |
| JP | 2011-220160 A | 11/2011 |

OTHER PUBLICATIONS

Extended European Search Report dated Dec. 23, 2015.

*Primary Examiner* — Joseph Dallo
(74) *Attorney, Agent, or Firm* — Rabin & Berdo, P.C.

(57) ABSTRACT

A fuel supply device is provided with a fuel pump and a filter. The fuel pump supplies fuel from a fuel tank to an engine. The filter is disposed upstream from the fuel pump in a fuel supply channel. The filter includes a first filter portion and a second filter portion. The first filter portion and the second filter portion filter the fuel. The second filter portion is disposed above the first filter portion when the filter is disposed inside the fuel tank. A density of gaps in the second filter portion is larger than a density of gaps in the first filter portion.

20 Claims, 8 Drawing Sheets

(56) References Cited

U.S. PATENT DOCUMENTS 8,616,403 B2 * 12/2013 Hisadomi ..... B60K 15/03 220/562
9,157,393 B2 * 10/2015 Fulton ..... F02D 41/064
2003/0226791 A1 * 12/2003 Kimura ..... B01D 29/01 210/155
2004/0065305 A1 * 4/2004 Ehara ..... F02M 37/0047 123/509
2005/0150826 A1 * 7/2005 Sato ..... B01D 35/0273 210/488
2005/0274361 A1 * 12/2005 Ikeya ..... B01D 35/027 123/457
2006/0076287 A1 * 4/2006 Catlin ..... B01D 35/0273 210/416.4
2006/0266693 A1 * 11/2006 Yoshida ..... B01D 29/56 210/335
2006/0266701 A1 * 11/2006 Dickerson ..... B01D 39/1623 210/503
2006/0291995 A1 * 12/2006 Ikeya ..... F02M 37/048 415/55.1
2007/0095733 A1 * 5/2007 Pizzo ..... B01D 35/0273 210/172.4
2008/0302339 A1 * 12/2008 Krogull ..... B60K 15/03504 123/516
2009/0039011 A1 * 2/2009 Sato ..... B01D 35/0273 210/491
2009/0064973 A1 * 3/2009 Dickenscheid ..... F02M 37/025 123/506
2012/0060935 A1 * 3/2012 Carter ..... F02M 21/0212 137/14
2012/0216778 A1 * 8/2012 Fulton ..... F02D 41/064 123/445
2013/0008899 A1 * 1/2013 Hisadomi ..... B60K 15/03 220/86.2
2013/0233850 A1 * 9/2013 Treudt ..... F01N 3/2066 220/4.14

* cited by examiner

FUEL SUPPLY DEVICE AND SADDLE TYPE VEHICLE

CROSS-REFERENCE TO RELATED APPLICATIONS

This application claims priority to Japanese Patent Application No. 2013-076698 filed on Apr. 2, 2013, the entirety of which is hereby incorporated by reference in its entirety.

TECHNICAL FIELD

The present invention relates to a fuel supply device and a saddle type vehicle.

BACKGROUND ART

In recent years, in response to societal demands, lower environmental impact fuel injection systems (referred to as "F.I. system" below) are becoming mainstream as the fuel supply systems for the engines in saddle type vehicles. Usually, in an F.I system, a fuel pump pumps the fuel from inside a fuel tank to the engine injector.

Within an F.I. system, if the vehicle is driven and the engine is stopped when the engine has reached a high temperature, vaporized fuel (referred to below as vapor) may be generated in the fuel pump or in a pipe connecting the fuel pump and the fuel tank. The vapor may be caught in a filter used for removing the foreign particulates contained in the fuel, or may build up in the pipe and therefore inhibit the flow of fuel. Therefore, in the case where the engine is stopped after reaching a high-temperature, and the engine is restarted after a considerable amount of time has passed since the engine has stopped (referred to below as the "high-temperature restart time"), the vapor becomes the primary cause of degradation in the startup performance.

For instance, in the fuel supply system described in Japanese Laid-open Patent Publication Number 2011-220160, the fuel pump is placed below the fuel tank. The fuel pump pumps the fuel from inside the fuel tank to the injector. Additionally, a cylindrical filter is placed above the fuel pump. The top end of the filter is formed flat. In other words, the top end of the cylindrical filter is flat and orthogonal to the progression direction of the vapor generated inside the fuel pump. The fuel supply system described in Japanese Laid-open Patent Publication Number 2011-220160 relates to the ability of the vapor to be discharged from the inside of the filter to the outside.

SUMMARY OF INVENTION

Technical Problem

However, merely making the top end of the filter flat and orthogonal may not be adequate for discharging the vapor.

Incidentally, the ease with which the vapor is discharged depends upon the density of the gaps in the filter; the larger the density of the gaps, the easier the vapor is discharged. As the density of the gaps grows larger, the ability to remove foreign particulates deteriorates. If the ability to remove foreign particulates deteriorates, it is possible that the durability of the fuel pump will deteriorate. In other words, it tends to be difficult to increase both the ability to remove foreign particulates and the ability to discharge the vapor. Consequently, startup performance may be limited at a high-temperature restart time.

The present invention aims to address problems relating to the startup performance of the engine at the high-temperature restart time.

Solution to Problem

A fuel supply device according to a first aspect of the present invention is provided with a fuel pump, and a filter. The fuel pump supplies fuel from the fuel tank to the engine. The filter is disposed upstream from the fuel pump in a fuel supply channel. The filter includes a first filter portion and a second filter portion. The first filter portion and the second filter portion filter the fuel. The second filter portion is disposed above the first filter portion when the filter is disposed inside the fuel tank. A density of gaps in the second filter portion is larger than a density of gaps in the first filter portion.

In this fuel supply device, the vapor generated inside the fuel supply channel is discharged from the second filter portion. Given that the vapor rises within the fuel, the vapor will be easily discharged from the second filter portion, which is located above the first filter portion. Additionally, the foreign particulates within the fuel are primarily filtered by the first filter portion. Given that the foreign particulates tend to collect at the bottom portion of the fuel, the foreign particulates can be more effectively filtered by the first filter portion, which is located below the second filter portion. Accordingly, in the fuel supply device according to the present aspect, it is possible to increase both the ability to remove foreign particulates and the ability to discharge vapor. Thereby it is possible to provide a desired startup performance at the high-temperature restart time of the engine.

The second filter portion may be located at the topmost position in the filter among the sections for filtering the fuel with the filter placed inside the fuel tank. In this case, the vapor can be more efficiently discharged from the second filter portion. Additionally, this prevents the foreign particulates in the fuel from passing through the filter from the second filter portion.

The longitudinal direction of the filter may correspond with the vertical direction with the filter placed inside the fuel tank. In this case, the filter has an elongated shape in the vertical direction inside the fuel tank. Therefore, it is possible to secure a larger filter surface area for the filter. In addition, the second filter portion may be placed at a higher location, and therefore further increase the ability to remove the foreign particulates and the ability to discharge the vapor.

The length of the first filter portion in the vertical direction may be more than the length of the second filter portion in the vertical direction with the filter placed inside the fuel tank. This further increases the ability to remove foreign particulates.

The first filter portion may be formed as a mesh. The second filter portion may be formed as a coarser mesh than the first filter portion. This allows the density of the gaps to be easily set.

The filter may have a cylindrical shape. This allows the mounting seat for the filter to be configured to be relatively small with the filter placed inside the fuel tank.

The fuel pump may also include an intake port for fuel. The filter may be placed to extend towards the top from the intake port with the filter placed inside the fuel tank. In this case, the vapor generated inside the fuel pump will rise from the intake port towards the filter. Accordingly, this facilitates the vapor flowing from inside the fuel pump towards the filter. Therefore, this allows the vapor to be efficiently discharged from inside the fuel pump.

The filter may be fixed to the fuel pump. This facilitates the vapor flowing from inside the fuel pump towards the filter. Therefore, this allows the vapor to be efficiently discharged from inside the fuel pump.

A saddle type vehicle according to the second aspect of the present invention is provided with a fuel tank, an engine, and the above described fuel supply device.

The fuel pump may be placed at below the fuel tank. In this case, the fuel pump will be more affected by external heat versus the case where the fuel pump is placed on the inside of the fuel tank; however, the above mentioned fuel supply device may provide a desired startup performance of the engine at high-temperature restart time.

The bottom portion of the fuel tank may include an outflow port for fuel. The fuel pump may be attached to the outflow port of the fuel tank. This facilitates the vapor flowing from inside the pump to inside the fuel tank. Therefore, the vapor generated inside the fuel pump can be more effectively discharged into the fuel tank.

The saddle type vehicle may be further provided with a fuel pipe. The fuel pipe connects the fuel tank and the fuel pump. The bottom portion of the fuel tank may include an outflow port for fuel. The fuel pipe may be attached to the outflow port of the fuel tank. This facilitates the vapor flowing from inside the fuel pipe to the fuel tank. Therefore, the vapor generated inside the fuel pipe may be more effectively discharged into the fuel tank.

The fuel pump may be placed above the engine. In this case, the fuel pump will be more affected by external heat versus the case where the fuel pump is placed on the inside of the fuel tank. However, the above described fuel supply device may provide a desired startup performance of the engine at the high-temperature restart time.

Advantageous Effects of Invention

The present invention may provide a desired startup performance of the engine at high-temperature restart time.

DETAILED DESCRIPTION OF THE EMBODIMENTS

Figure 1:
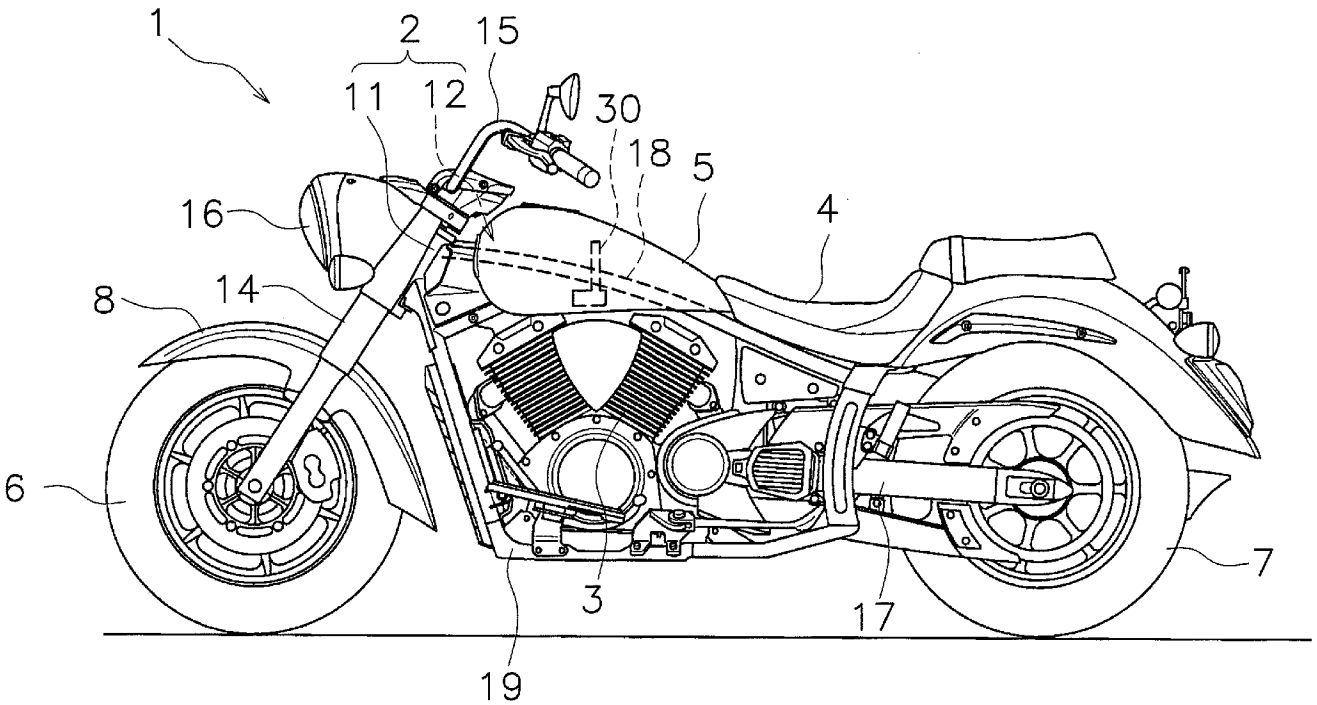
FIG. 1 is a side view of a saddle type vehicle according to one embodiment.

A saddle type vehicle 1 according to an embodiment of the present invention is illustrated in FIG. 1. FIG. 1 is a side view of the saddle type vehicle 1. Additionally in the following description unless particularly described, the terms front, rear, left, and right are meant to signify the front, rear, left, and right from the view of the rider on the saddle type vehicle 1. The saddle type vehicle 1 is provided with a vehicle body frame 2, an engine 3, a seat 4, a fuel tank 5, a front wheel 6, and a rear wheel 7.

The vehicle body frame 2 includes a head pipe 11 and a main frame 12. A front fork 14 is supported through the head pipe 11. A handle 15 is fixed to the top end of the front fork 14. Additionally, a headlight 16 is placed in front of the head pipe 11. The front wheel 6 is rotatably supported at the lower portion of the front fork 14. A front fender 8 is placed above the front wheel 6.

The main frame 12 includes an upper frame 18 and a lower frame 19. The upper frame 18 and the lower frame 19 are placed behind the head pipe 11, and are connected to the head pipe 11. The lower frame 19 is placed below the upper frame 18. A swing arm 17 is coupled to the rear portion of the main frame 12 in a vertically swingable manner. The rear wheel 7 is rotatably supported at the rear portion of the swing arm 17.

The seat 4 and the fuel tank 5 are attached to the upper portion of the main frame 12. The fuel tank 5 is placed in front of the seat 4. The fuel tank 5 is placed behind the head pipe 11.

The engine transmits drive power to the rear wheel 7 via a transmission component such as a chain. The engine 3 is placed below the fuel tank 5. The main frame 12 supports the engine 3. The engine 3 may be for example, a V-type air-cooled engine.

Figure 2:
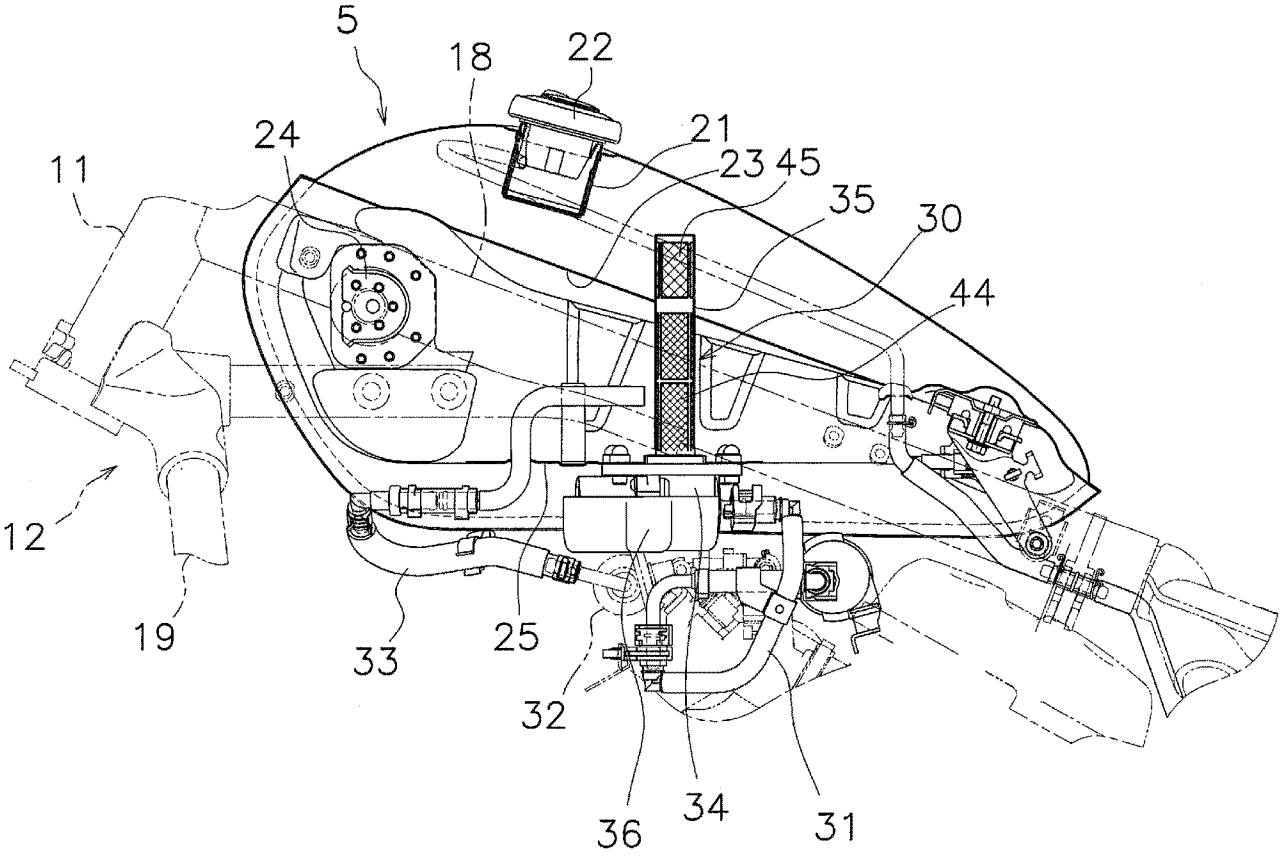
FIG. 2 is an exploded side view of near a fuel tank.
Figure 3:
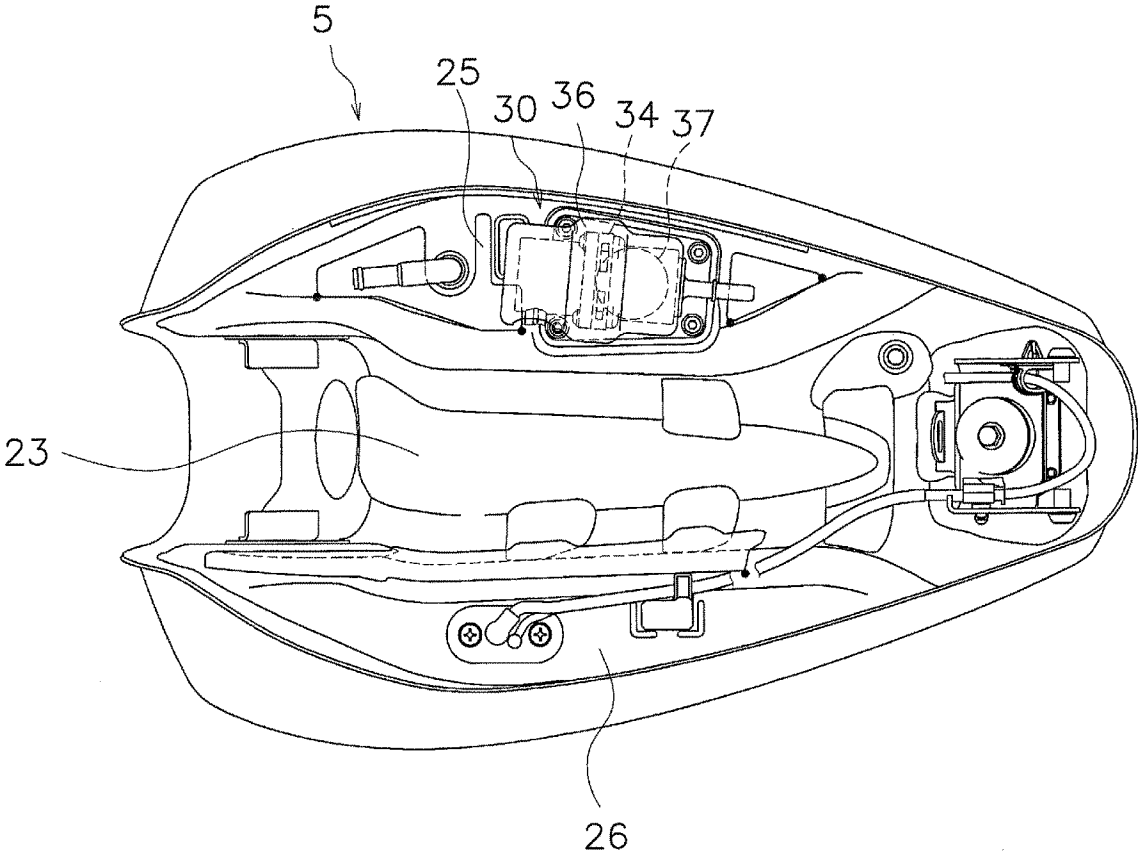
FIG. 3 is a bottom view of the fuel tank.

FIG. 2 is an exploded side view of near the fuel tank 5. FIG. 3 is a bottom view of the fuel tank 5. As illustrated in FIG. 2, the fuel tank 5 is attached to the main frame 12 by way of a mount component 24. A filler 21 and a filler cap 22 are attached to the top portion of the fuel tank 5. The bottom portion of the fuel tank 5 includes a recess portion 23 that is depressed upward towards the top. The recessed portion 23 extends in the front-back direction. The fuel tank 5 is placed so that the upper frame 18 passes through the recessed portion 23.

As illustrated in FIG. 3, the bottom portion of the fuel tank includes a first bottom surface 25 and a second bottom surface 26. The recessed portion 23 is located between the first bottom surface 25 and the second bottom surface 26 in a vehicle width direction. The first bottom surface 25 and the second bottom surface 26 are located below the recessed portion 23. The first bottom surface 25 and the second bottom surface 26 are placed generally in a horizontal direction. In the present embodiment, the first bottom surface 25 is located on the left side of the recessed portion 23 and the second bottom surface 26 is placed on the right side of the recessed portion 23.

The saddle type vehicle 1 is provided with a fuel supply device 30. The fuel supply device 30 supplies the engine 3 with the fuel stored in the fuel tank 5. The fuel supply device 30 is connected to an injector (not shown) in the engine 3 via a fuel pipe 31. Moreover, a pressure regulator 32 is connected to the fuel pipe 31. The pressure regulator 32 is connected to the fuel tank 5 by way of a return fuel pipe 33.

Figure 4:
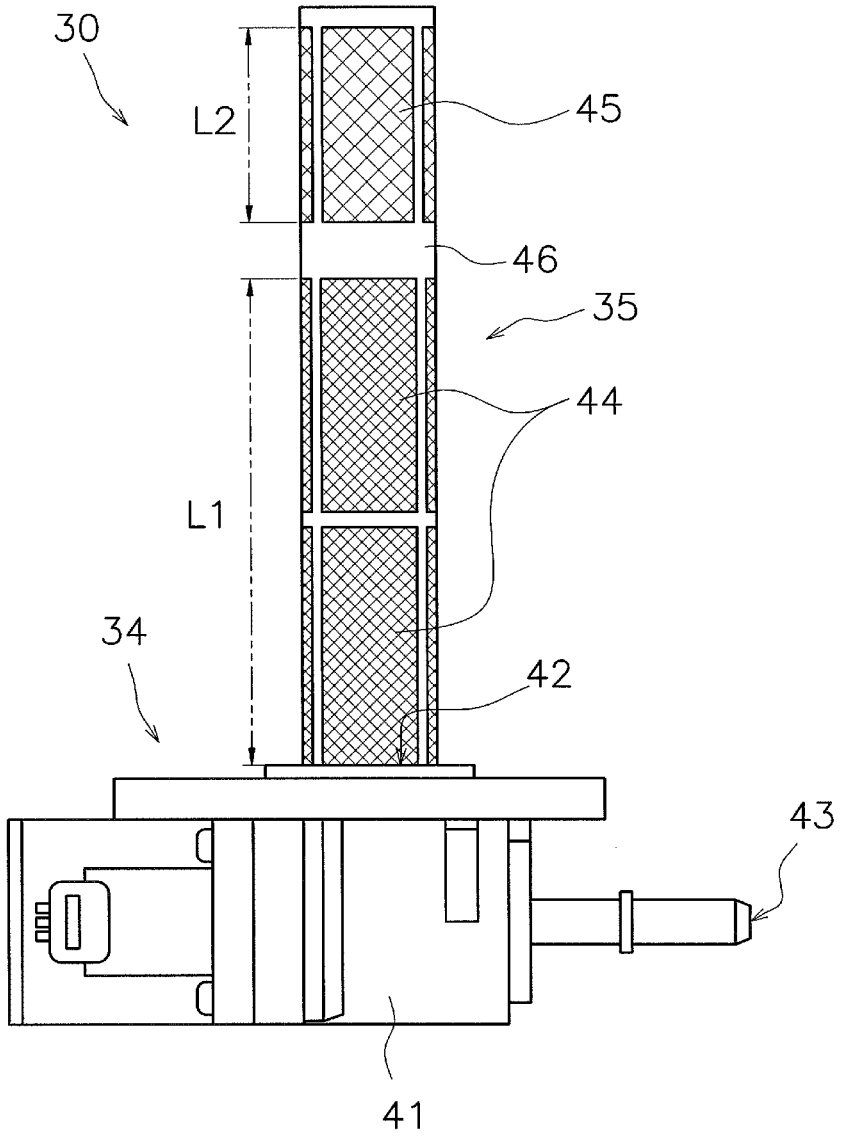
FIG. 4 is a side view of a fuel supply device.
Figure 5:
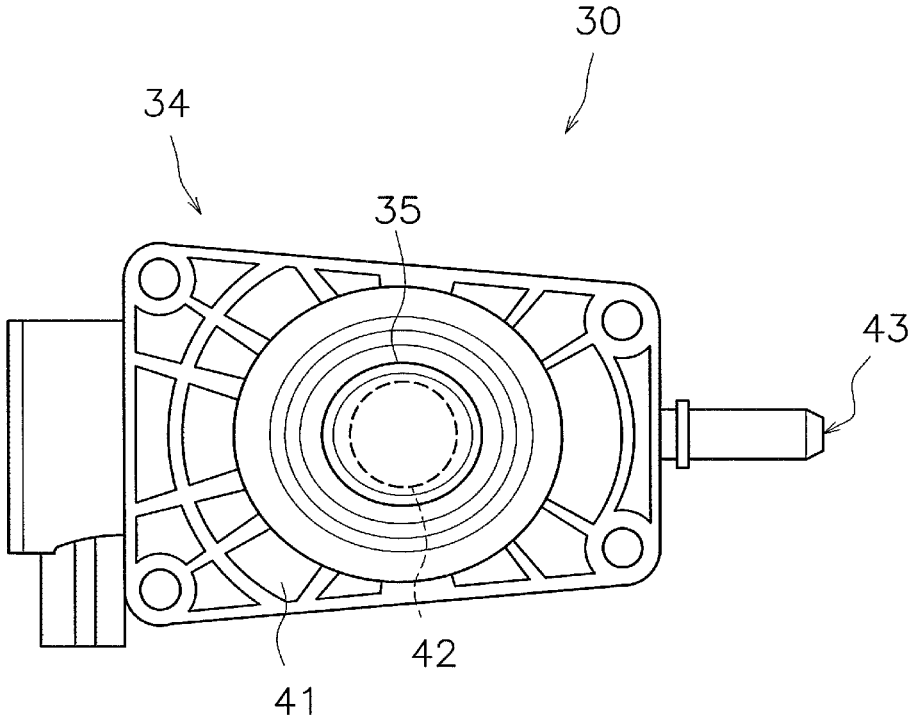
FIG. 5 is a top view of the fuel supply device.

FIG. 4 is a side view of the fuel supply device 30. FIG. 5 is a top view of the fuel supply device 30. As illustrated in FIG. 4 and FIG. 5, the fuel supply device 30 is provided with a fuel pump 34 and a filter 35. The fuel pump 34 supplies fuel from the fuel tank 5 to the engine 3. In the present embodiment, the fuel pump 34 is a piston pump. As illustrated in FIG. 2 and FIG. 3 the fuel pump 34 is placed outside of the fuel tank 5. The fuel pump 34 is placed below the fuel tank 5. More specifically, the fuel pump 34 is placed below the first bottom surface 25. Furthermore, in the FIG. 2 and FIG. 3, a cover member 36 is attached to the fuel pump 34. As illustrated in FIG. 3, the bottom portion of the fuel tank 5 includes an outflow port 37 for fuel. The fuel pump 34 is attached to the outflow port 37 of the fuel tank 5. In other words, the fuel pump 34 is directly attached to the fuel tank 5.

As illustrated in FIG. 4 the fuel pump 34 includes a pump body 41, an intake port 42, and a discharge port 43. The fuel passes through the intake port 42 and is taken into the pump body 41, and discharged from the discharge port 43. The intake port 42 is provided on the top surface of the pump body 41. The discharge port 43 protrudes in a horizontal direction from the pump body 41. In the present embodiment, the discharge port 43 protrudes from behind the pump body 41. The fuel pipe 31 described above is attached to the discharge port 43.

The filter 35 is provided further upstream than the fuel pump 34 in the fuel supply channel. The filter 35 is fixed to the fuel pump 34. More specifically, the filter 35 is attached to the intake port 42. The filter 35 is placed inside the fuel tank 5. The filter 35 has a cylindrical shape. The longitudinal direction of the filter 5 coincides with the vertical direction with the filter 35 placed inside the fuel tank 5. The filter 35 is placed to extend towards the top from the intake port 42 with the filter 35 placed inside the fuel tank 5.

The filter 35 includes a first filter portion 44 and a second filter portion 45. The first filter portion 44 and the second filter portion 45 filters the fuel. The density of the gaps in the second filter 45 is larger than the density of the gaps in the first filter portion 44. More specifically, the first filter portion 44 and the second filter portion 45 are formed from a mesh, and the second filter portion 45 is formed using a coarser mesh than the first filter portion 44. The filter 35 includes a filter frame portion 46. The filter frame portion 46 supports the first filter portion 44 and the second filter portion 45. The first filter portion 44 and the second filter portion 45 constitute the side surfaces of the filter 35.

The length L1 of the first filter portion 44 in the vertical direction is more than the length L2 of the second filter portion 45 in the vertical direction, with the filter 35 placed inside the fuel tank 5. For example, the length L1 of the first filter portion 44 in the vertical direction is equal to or more than two times the length L2 of the second filter portion 45 in the vertical direction. The second filter portion 45 is located above the first filter portion 44 with the filter placed inside the fuel tank 35. The second filter portion 45 is located at the topmost position in the filter 35 among the sections for filtering the fuel with the filter 35 placed inside the fuel tank 5.

As illustrated in FIG. 2, the lower end of the filter 35 is located on the first bottom surface 25 of the fuel tank 5. The top end of the filter 35 is located above the upper frame 18. The top end of the filter 35 is located below the filler 21. The filter 35 is located rearward of the filler 21. At least one portion of the second filter portion 45 is located above the top surface of the recessed portion 23 of the fuel tank 5. The first filter portion 44 is located below the top surface of the recessed portion 23 of the fuel tank 5. Additionally, at least one portion of the second filter portion 45 is located above the upper frame 18.

The features of the saddle type vehicle 1 and the fuel supply device 30 according to the present embodiment are as follows. In the fuel supply device 30, the vapor generated inside the fuel pump 34 rises and flows towards the filter 35. The vapor rises inside the filter 35 until it arrives at the second filter portion 45. The mesh of the second filter portion 45 is coarser than the mesh of the first filter portion 44, therefore, the vapor can be effectively discharged from the second filter portion 45 to the inside of the fuel tank 5.

Moreover, when the fuel inside the fuel tank 5 passes through the filter and is taken into the fuel pump 34, the foreign particulates in the fuel are filtered by the first filter portion 44. The foreign particulates in the fuel tend to collect at the bottom portion, and therefore most of the foreign particulates gather around the first filter portion 44 which is located below the second filter portion 45. The mesh of the first filter portion 44 is finer than the mesh of the second filter portion 45. Therefore, the foreign particulates may be more effectively filtered by the first filter portion 44.

As above described, the fuel supply device 30 of the present example is capable of increasing both the ability to remove the foreign particulates and the ability to discharge vapor. Thereby, it is possible to provide a desired startup performance of the engine 3 at the high-temperature restart time.

The fuel pump 34 is placed outside the fuel tank 5. More specifically the fuel pump 34 is placed below the fuel tank 5, and is placed above the engine 3. When the fuel pump 34 is placed so as to be located in this manner, the fuel pump tends to be more greatly affected by external heat than in the case where the fuel pump 34 is placed inside the fuel tank 5. However the fuel supply device 30 according to the present embodiment, as above described, is capable of increasing both the ability to remove foreign particulates, and the ability to discharge vapor. Therefore, the fuel pump 34, even if placed in the above mentioned manner; will still provide a desired startup performance of the engine 3 at the high-temperature restart time.

The second filter portion 45 is located at the topmost position in the filter 35 among the sections for filtering the fuel with the filter 35 placed inside the tank 5. Therefore, the vapor may be more efficiently discharged from the second filter portion 45. Additionally, this prevents foreign particulates in the fuel from passing through the filter 35 from the second filter portion 45.

The longitudinal direction of the filter 35 coincides with the vertical direction, with the filter 35 placed inside the fuel tank 5. In other words, the filter 35 has elongated shape in the vertical direction inside the fuel tank 5. Accordingly, it is possible to secure a larger filter surface area for the filter 35. Additionally, since it is possible to place the second filter portion 45 at a higher location, then the ability to remove foreign particulates, and the ability to discharge vapor may be further increased.

The length L1 of the first filter portion 44 in the vertical direction is more than the length L2 of the second filter portion 45 in the vertical direction with the filter 35 placed inside the fuel tank 5. Therefore, it is possible to further increase the ability to remove foreign particulates.

The first filter portion 44 and the second filter portion 45 are formed from a mesh. Therefore, meshes of different roughness may be used to form the first filter portion 44 and the second filter portion 45 to thereby facilitate setting the density of the gaps in the first filter portion 44 and in the second filter portion 45.

The filter 35 is placed so as to extend towards the top from the intake port 42 with the filter of 35 placed inside the fuel tank 5. Thus, the vapor generated inside the fuel pump 34 will rise from the intake port 42 towards the filter 35. This therefore facilitates the vapor flowing from inside the pump 34 towards the filter 35. Therefore, the vapor may be more efficiently discharged from inside the fuel pump 34.

The filter 35 is fixed to the fuel pump 34. This therefore facilitates the vapor flowing from the fuel pump 34 to inside the filter 35. Therefore, the vapor will be more efficiently discharged from inside the fuel pump 34.

The fuel pump 34 is attached to the outflow port 37 of the fuel tank 5. This therefore facilitates the flow of the vapor from inside the fuel pump 34 to inside the fuel tank 5. Therefore, the vapor generated inside the fuel pump 34 may be more efficiently discharged into the fuel tank 35.

The present invention is not limited to the above mentioned embodiments and may be modified in various ways within the scope and spirit of the invention.

The saddle type vehicle 1 may include a motorcycle, an all-terrain vehicle, or a snowmobile. Furthermore the motorcycle may include scooters or mopeds.

The engine 3 is not limited to an air-cooled engine, and may include various other types of engines such as a water-cooled engine. The engine 3 is not limited to a V-type engine, and may include various other types of engines such as a parallel-engine, or a single-cylinder engine. The first filter portion 44 and the second filter portion 45 are not limited to being formed from mesh, and may be manufactured by any material capable of allowing fuel and vapor to pass therethrough and of filtering foreign particulates; for example, the first filter portion 44 and the second filter portion 45 may be manufactured from non-woven fabric.

The length L1 of the first filter portion 44 in the vertical direction may be less than two times the length L2 of the second filter portion 45 in the vertical direction. However, if the length L2 of the second filter portion 45 in the vertical direction were to be increased so that the first filter portion 44 became relatively shorter, then it would tend to be difficult to maintain the ability to remove foreign particulates with the first filter portion 44; therefore the length L1 of the first filter portion 44 in the vertical direction should preferably be more than the length L2 of the second filter portion 45 in the vertical direction.

The shape or placement of the filter 35 is not limited to the above mentioned shape or placement. For example, the longitudinal direction of the filter 35 may intersect with the vertical direction. The filter 35 may have a shape other than a cylinder, such as a rectangular column, or a cone.

Figure 6:
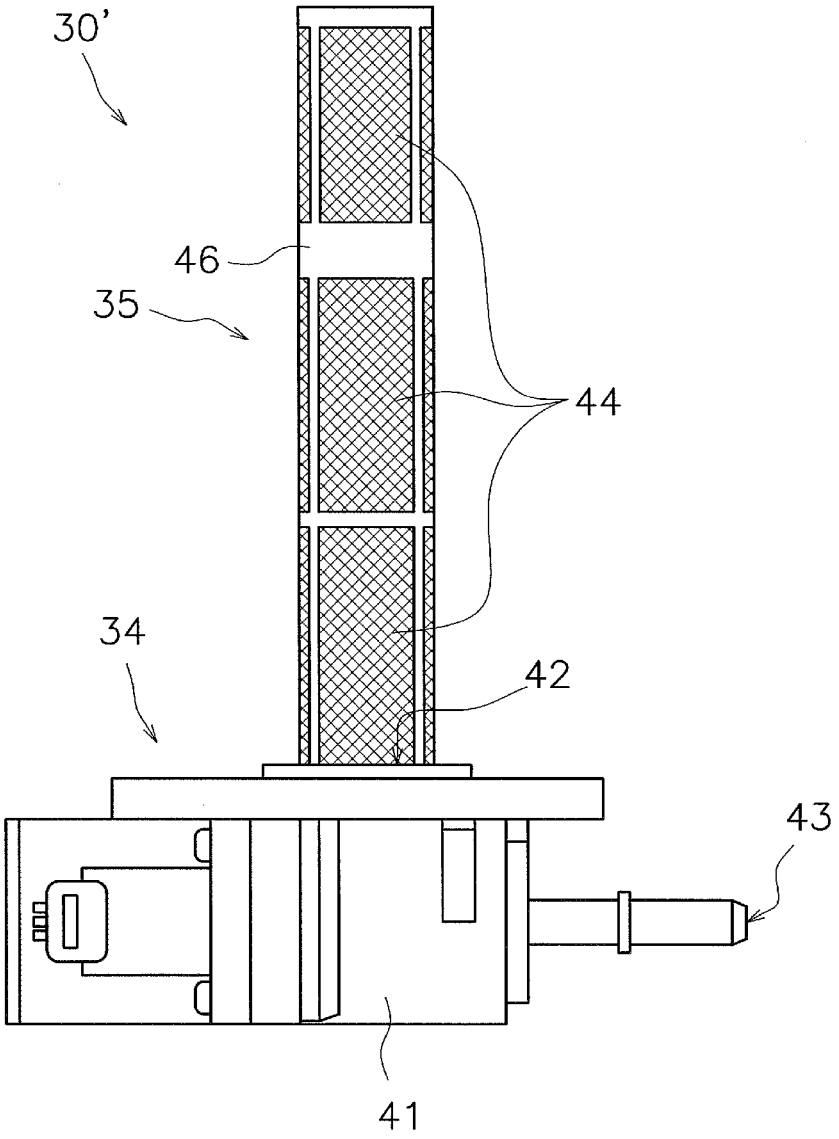
FIG. 6 is a side view of a fuel supply device according to another embodiment.
Figure 7:
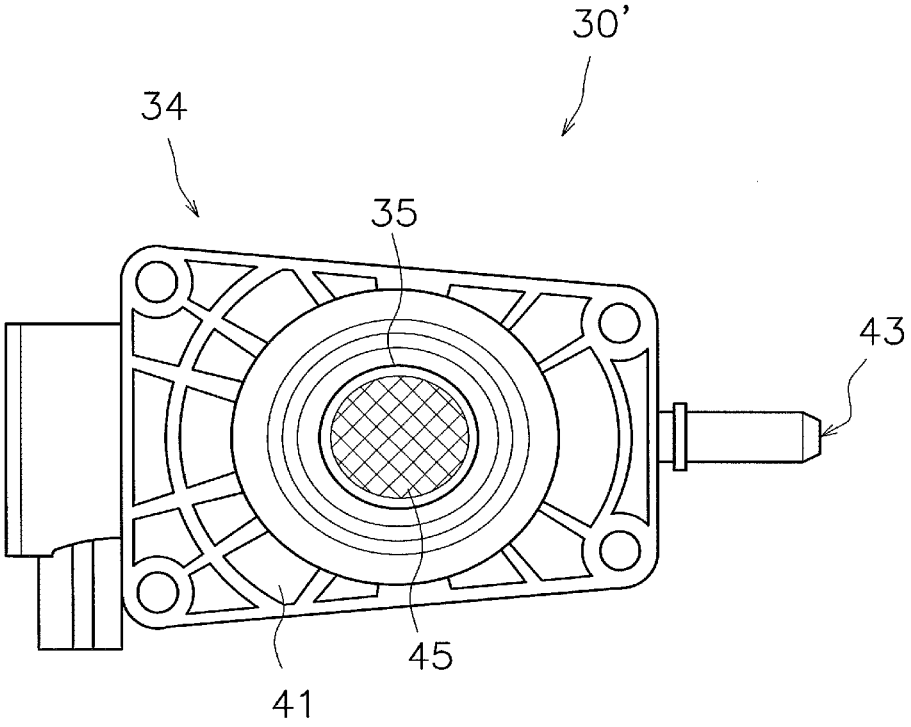
FIG. 7 is a top view of a fuel supply device according to another embodiment.

The portion where the first filter portion 44 and the second filter portion 45 are provided is not limited to the side surfaces of the filter 35. For example, FIG. 6 is a side view of a fuel supply device 30' according to another embodiment. FIG. 7 is a top view of the fuel supply device 30' according to another embodiment. In the fuel supply device 30' according to the other embodiment, the second filter portion 45 is provided on the top surface of the filter 35. The side surface of the filter 35 is provided as the first filter portion 44. In this case as well, the vapor is efficiently discharged from the second filter portion 45 to the inside of the tank. Additionally, the foreign particulates in the fuel are effectively filtered by the first filter portion 44.

The fuel pump 34 is not limited to a piston pump; other kinds of pumps may be used. For example, the fuel pump 34 may be a rotary pump which includes a rotor, such as an impeller.

The fuel pump 34 is not limited to being placed outside the fuel tank 5, and may be placed inside the fuel tank 5. Even if the fuel pump is placed inside the fuel tank 5, the vapor may be generated inside the fuel pump 34 due to the effect of heat. Therefore, even in the case where the fuel pump 34 is placed inside the fuel tank 5 the present invention is effective in providing a desired startup performance of the engine 3 at the high-temperature restart time.

In the above mentioned embodiment, while the pressure regulator 32 is provided independently of the fuel pump 34, the pressure regulator 32 may be provided combined with the fuel pump 34.

Figure 8:
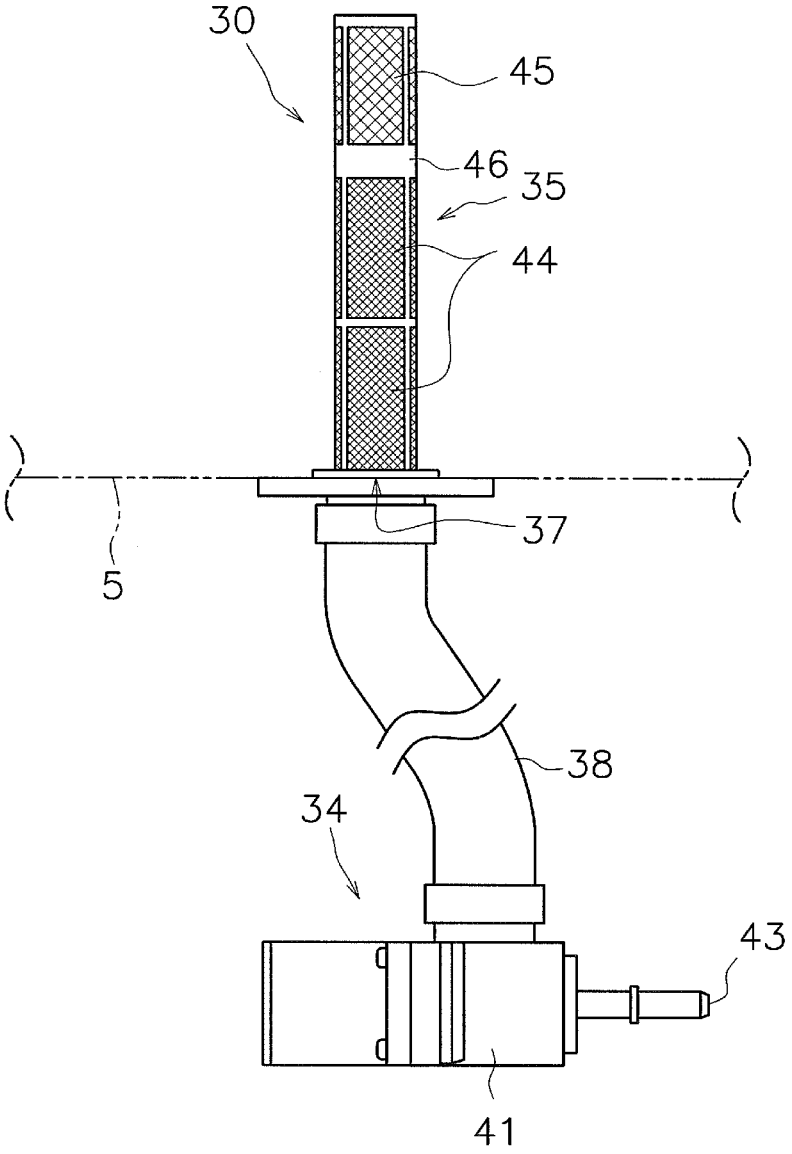
FIG. 8 is a schematic view illustrating a configuration of the fuel supply device according to another embodiment.

As illustrated in FIG. 8, if the fuel pump 34 is placed outside the fuel tank 35 the saddle type vehicle 1 may be provided with a fuel pipe 38. The fuel pipe 38 connects fuel tank 5 and the fuel pump 34. The fuel pipe 38 may be installed at the outflow port 37 of the fuel tank 5. For example, the pump 34 may be fixed to the above described vehicle body frame 2 by way of a bracket (not shown). Even in this case, the vapor generated inside the fuel pipe 38 passes through the outflow port 37, flows into the filter 35 in the fuel tank 5, and passes through the second filter portion 45 to be discharged into the fuel tank 5. Therefore, the vapor inside the fuel pipe 38 can be efficiently discharged into the fuel tank 5.

The invention claimed is:

1. A fuel supply device for supplying fuel stored in a fuel tank to an engine, a main frame attached to the fuel tank and supporting the engine, an upper frame of the main frame being disposed within a recessed portion of the fuel tank, the fuel supply device comprising:

a fuel pump that supplies the fuel from the fuel tank to the engine; and a filter that is disposed upstream from the fuel pump in a fuel supply channel;

wherein the filter includes a first filter portion that filters the fuel, and a second filter portion that filters the fuel;

wherein the second filter portion is disposed above both of the first filter portion and the recessed portion when the filter is disposed inside the fuel tank; and wherein a density of gaps in the second filter portion is larger than a density of gaps in the first filter portion so that the gaps in the second filter portion have a size at which vapor from the fuel pump is discharged through the gaps of the second filter portion.

2. The fuel supply device according to claim 1, wherein the second filter portion is disposed at the topmost position in the filter among sections for filtering the fuel with the filter disposed inside the fuel tank.

3. The fuel supply device according to claim 1, wherein a longitudinal direction of the filter coincides with a vertical direction with the filter disposed inside the fuel tank.

4. The fuel supply device according to claim 1, wherein with the filter disposed inside the fuel tank, the length of the first filter portion in the vertical direction is more than the length of the second filter portion in the vertical direction.

5. The fuel supply device according to claim 1, wherein:

the first filter portion and the second filter portion are each formed from a mesh; and the mesh of the second filter portion is coarser than the mesh of the first filter portion.

6. The fuel supply device according to claim 1, wherein the filter has a cylindrical shape.

7. The fuel supply device according to claim 1, wherein:

the fuel pump includes an intake port for fuel; and the filter is disposed so as to extend upward from the intake port with the filter disposed inside the fuel tank.

8. The fuel supply device according to claim 1, wherein the filter is fixed to the fuel pump.

9. A saddle type vehicle comprising:

a fuel tank having a recessed portion;

an engine;

a main frame supporting the engine and attached to the fuel tank, an upper frame of the main frame being disposed in the recessed portion, and a fuel supply device, the fuel supply device including:

a fuel pump that supplies fuel from the fuel tank to the engine; and a filter that is disposed upstream from the fuel pump in a fuel supply channel;

wherein the filter includes a first filter portion that filters the fuel, and a second filter portion that filters the fuel;

wherein the second filter portion is disposed above both of the first filter portion and the recessed portion when the filter is disposed inside the fuel tank; and wherein a density of gaps in the second filter portion is larger than a density of gaps in the first filter portion so that the gaps in the second filter portion have a size at which vapor from the fuel pump is discharged through the gaps of the second filter portion.

10. The saddle type vehicle according to claim 9, wherein the fuel pump is disposed below the fuel tank.

11. The saddle type vehicle according to claim 10, wherein:

a bottom portion of the fuel tank includes an outflow port for fuel; and the fuel pump is attached to the outflow port of the fuel tank.

12. The saddle type vehicle according to claim 10, further comprising:

a fuel pipe connecting the fuel tank and the fuel pump, wherein a bottom portion of the fuel tank includes an outflow port for fuel;

wherein the fuel pipe is attached to the outflow port of the fuel tank.

13. The saddle type vehicle according to claim 9, wherein the fuel pump is disposed above the engine.

14. The saddle type vehicle according to claim 9, wherein the second filter portion is stacked on the first filter portion in the vertical direction.

15. The saddle type vehicle according to claim 9, wherein the second filter portion is disposed completely above the first filter portion in the vertical direction.

16. The fuel supply device according to claim 1, wherein the second filter portion is stacked on the first filter portion in the vertical direction.

17. The fuel supply device according to claim 1, wherein the second filter portion is disposed completely above the first filter portion in the vertical direction.

18. The saddle type vehicle according to claim 9, wherein the second filter portion is disposed above the upper frame when the filter is disposed inside the fuel tank.

19. The saddle type vehicle according to claim 9, wherein the first filter portion is located below a top surface of the recessed portion.

20. The fuel supply device according to claim 1, wherein the second filter portion is disposed above the upper frame when the filter is disposed inside the fuel tank, and the first filter portion is located below a top surface of the recessed portion.

* * * * *